United States Patent [19]

Debs

[11] Patent Number: 4,487,243

[45] Date of Patent: Dec. 11, 1984

[54] VENETIAN BLIND

[75] Inventor: Victor Debs, Staten Island, N.Y.

[73] Assignee: Levolor Lorentzen, Inc., Lyndhurst, N.J.

[21] Appl. No.: 380,947

[22] Filed: May 21, 1982

[51] Int. Cl.[3] ..... E06B 9/30

[52] U.S. Cl. ..... 160/168R; 160/176 R; 160/178 R

[58] Field of Search ..... 160/166-178

[56] References Cited

U.S. PATENT DOCUMENTS

| | | | |
|---|---|---|---|
| 2,494,858 | 1/1950 | Burns | 160/173 |
| 2,744,572 | 5/1956 | Lorentzen | 160/178 C |
| 3,269,453 | 8/1966 | Vecchiarelli et al. | 160/176 |
| 3,333,905 | 8/1967 | Hennequin | 160/178 R |
| 3,425,479 | 2/1969 | Lorentzen et al. | 160/176 R |
| 3,425,480 | 2/1969 | Anderle et al. | 160/178 R |
| 3,447,585 | 6/1969 | Lorentzen et al. | 160/178 R |
| 3,485,286 | 12/1969 | Lorentzen et al. | 160/178 R |
| 3,795,266 | 3/1974 | Debs | 160/168 |
| 3,828,838 | 8/1974 | Anderle et al. | 160/176 R |
| 3,918,513 | 11/1975 | Englund et al. | 160/176 R |
| 3,952,789 | 4/1976 | Marotto | 160/168 R |
| 4,141,402 | 2/1979 | Marotto | 160/176 R |
| 4,237,957 | 12/1980 | Hensel | 160/178 R |
| 4,245,688 | 1/1981 | Vecchiarelli | 160/178 C |
| 4,316,493 | 2/1982 | Arena | 160/168 R |

FOREIGN PATENT DOCUMENTS

| | | | |
|---|---|---|---|
| 1252878 | 10/1967 | Fed. Rep. of Germany | 160/178 |

*Primary Examiner*—Peter M. Caun

[57] ABSTRACT

A venetian blind with a very low head channel and narrow slats, having a lift cord lock, a tilter, and cradles, all of which can simply be snapped in place in the head channel. The cord lock has an integral, one-piece sheet metal housing. The tilter has a plastic housing open at the top through which the gear and worm shaft can be introduced before being closed with a cover. The blind has drums forming plastic sleeves split to fit over the tilt rod and with slits for receiving barbed end portions of ladders for suspending the slats. The lower ends of the ladders and of the lift cord are fastened to the bottom rail of the blind by button-like plastic caps.

2 Claims, 28 Drawing Figures

VENETIAN BLIND

BACKGROUND OF THE INVENTION

The present invention relates to a venetian blind and, more specifically, to a venetian blind having a blind head of very low height and also slats of narrow width, each on the order of approximately 1 inch.

It is an object of the present invention to provide a venetian blind of this type, often referred to as a mini-blind, which can be produced at a very low cost, and lends itself to high-volume production.

Further objects will become evident from the further description.

BRIEF SUMMARY OF THE INVENTION

The venetian blind according to the present invention is characterized by a novel over-all structure, and by novel features in several components of the over-all structure, namely the lift cord lock, cradle, drum, tilter, ladder cap and cord cap.

BRIEF DESCRIPTION OF THE DRAWINGS

The invention is illustrated, by way of example, in the accompanying drawings, in which.

DETAILED DESCRIPTION OF A PREFERRED EMBODIMENT

Figures 1, 2:
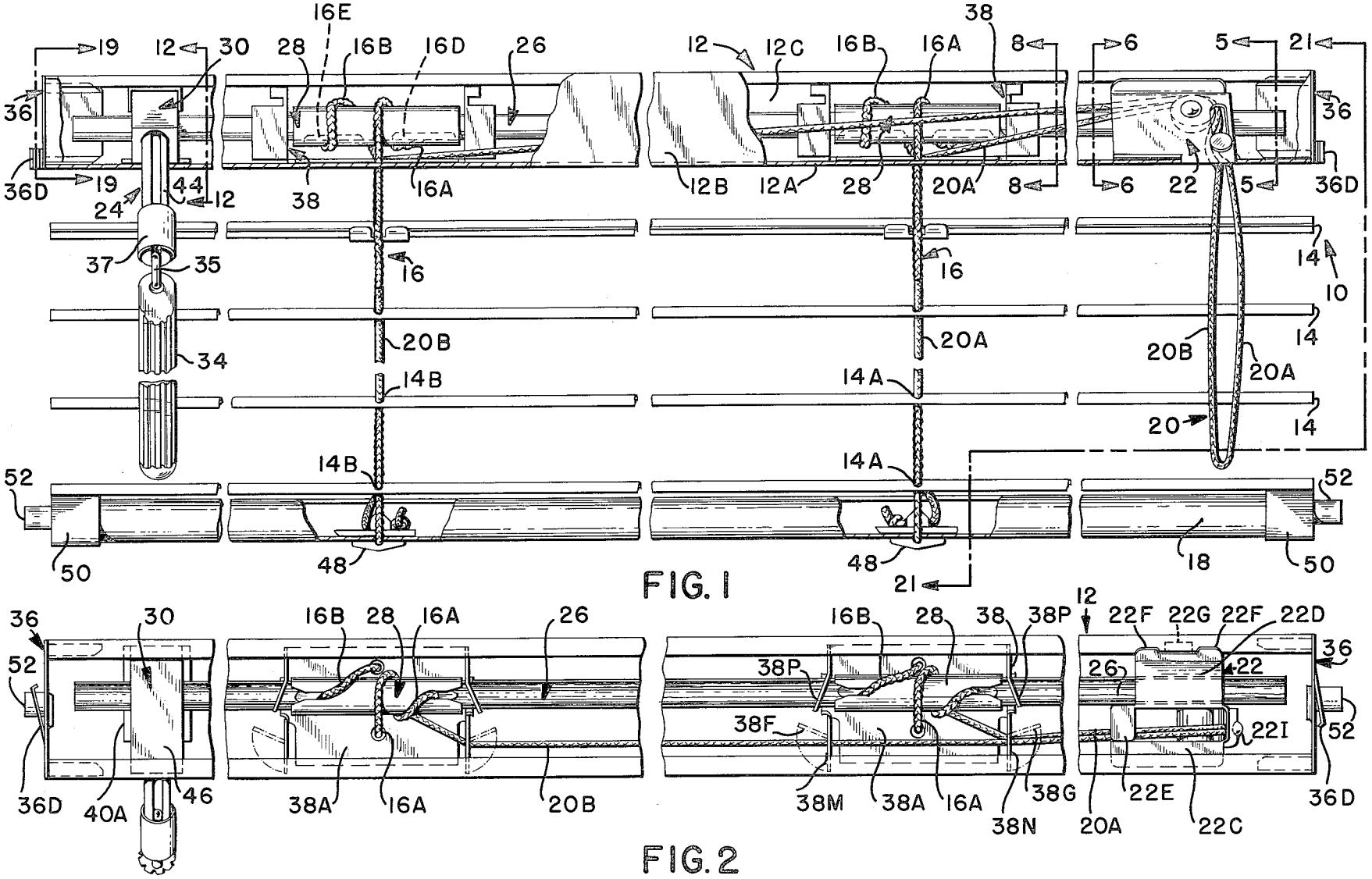
FIG. 1 is a front view of the venetian blind according to the present invention, showing partially in section details of the blind head, including a cord lock, a cradle, and a wand-tilting mechanism.
FIG. 2 is a top view of the venetian blind of FIG. 1, but with the tilt rod rotated by 180°.
Figure 21:
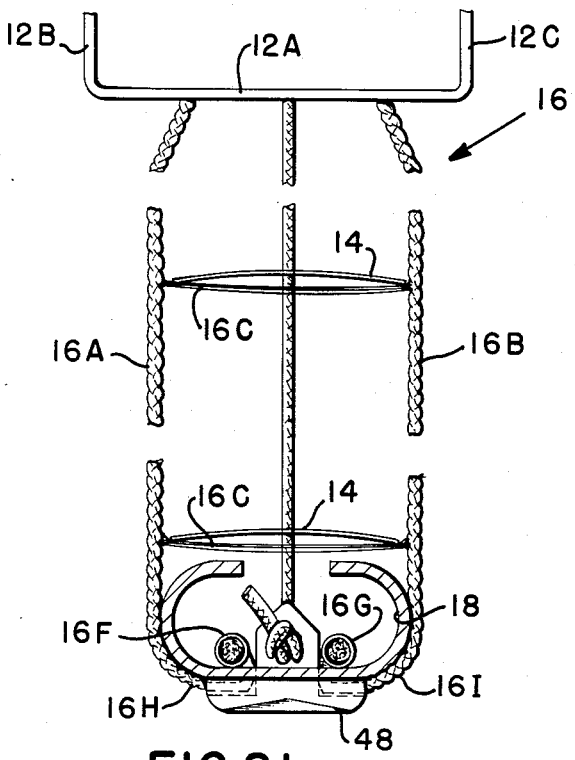
FIG. 21 is an end view partly in section of the venetian blind of FIG. 1 showing the ladders, lift cords and bottom rail of the venetian blind.
Figure 22:
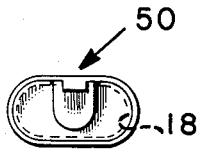
FIG. 22 is an end view of an end cap provided at the end of the bottom rail.
Figure 23:
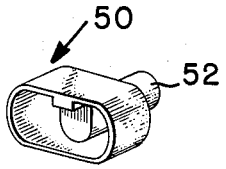
FIG. 23 is a perspective view of the end cap of FIG. 22.

Referring now to the drawings in detail, FIGS. 1 and 2 are a front view, partially in section, and a top view, respectively, of a venetian blind according to the present invention. The venetian blind, generally designated with the reference numeral 10, comprises a venetian blind head 12 from which are suspended a large number of slats 14 by means of ladder assemblies 16 having front and rear side pieces **16*a* and 16*b* and rungs 16*c* (FIG. 21). The lower ends of side pieces 16*a* and 16*b* are connected to a bottom rail 18. The venetian blind of FIG. 1 also comprises a cord 20 with strands 20*a* and 20*b* for lifting and lowering the bottom rail 18 and thereby slats 14 one by one and a locking mechanism 22 for locking the lift cord 20 in various position. Furthermore, the venetian blind includes means 24 for rotating a tilt rod 26 on which are mounted tape drums 28 having connected thereto and wound therearound the upper ends of the ladder assemblies 17. Rotation of the tilt rod 26 in one direction or the other about its longitudinal axis will cause the ladder assemblies 16 to be tilted, whereby the slats 14 are moved from an open position shown in FIG. 1 to tilted positions closing the venetian blind, and vice versa. The means 24 for rotating the tilt rod 26 include a tilter 30, a worm shaft 44 and a wand 34, and the tilt rod 26 is journalled in cradles 38 within which also the drums 28** are journalled.

The blind head 12 has a bottom **12*a*, and side walls 12*b*, 12*c* and is closed at both ends by end brackets 36**.

Figure 5:
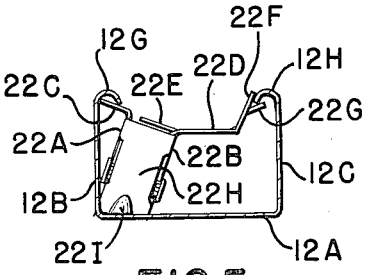
FIGS. 5 and 6 are sections taken along line 5—5 and 6—6 respectively, of FIG. 1, showing a portion of the cord lock mechanism.
Figure 6:
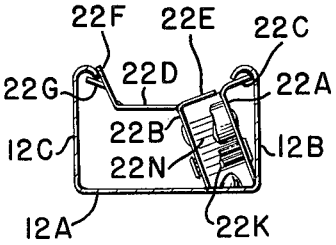
Figure 7:
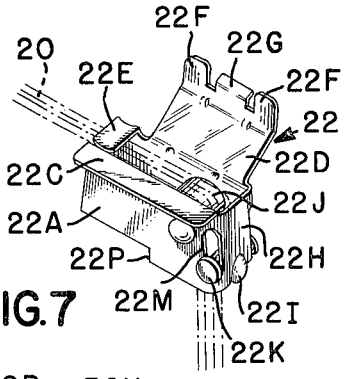
FIG. 7 is a perspective view of the cord lock mechanism.
Figure 8:
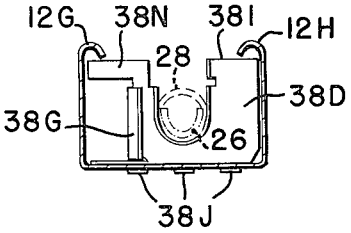
FIG. 8 is a section taken along the line 8—8 of FIG. 1 and shows an end view of the cradle.
Figure 13:
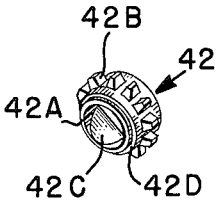
FIGS. 13, 14, 15 and 16 are perspective view of component parts of the tilting mechanism of FIG. 11; namely the gear, housing, worm shaft and cover.
Figure 9:
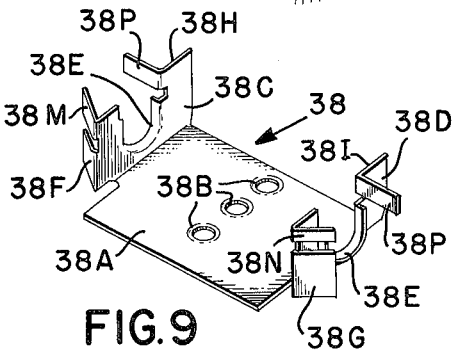
FIG. 9 is a perspective view of the cradle of FIG. 8.
Figure 10:
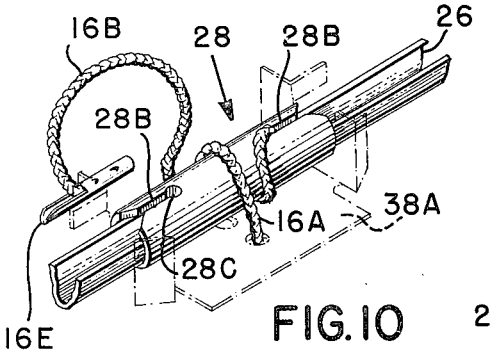
FIG. 10 is a perspective view of a drum supported in the cradle for rotation and having connected thereto the ladders of the venetian blind.
Figure 14:
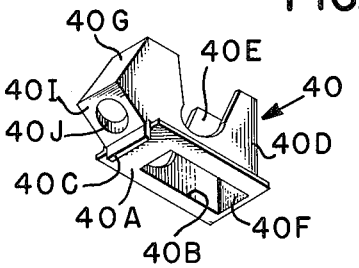
Figure 17:
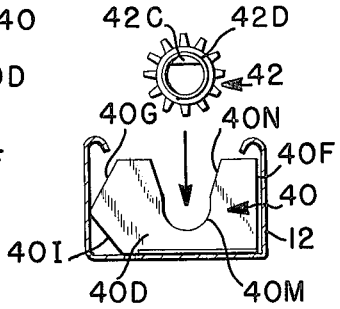
FIGS. 17 and 18 are end views similar to that of FIG. 12 but showing steps in assembling of the tilting mechanism.
Figure 19:
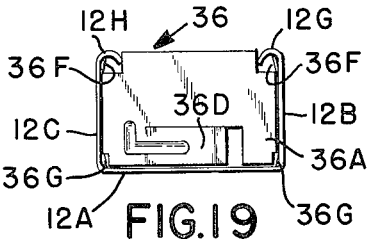
FIG. 19 is an end view taken along the line 19—19 of FIG. 1 and shows an end brace.
Figure 16:
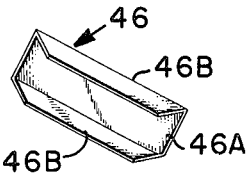
Figure 20:
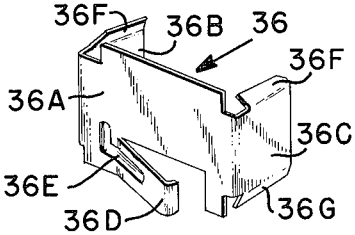
FIG. 20 is a perspective view of the end brace of FIG. 19.
Figure 3:
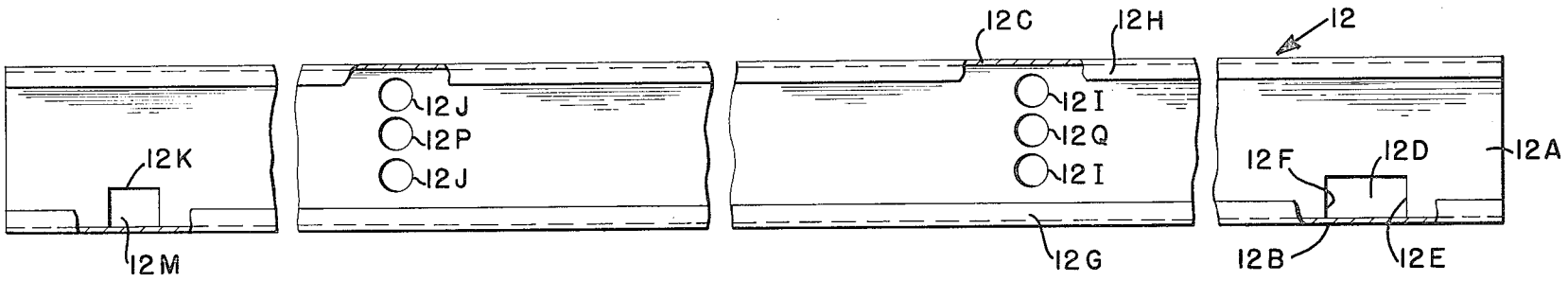
FIGS. 3 and 4 are a top and front view, respectively of the venetian blind head per se.
Figure 4:
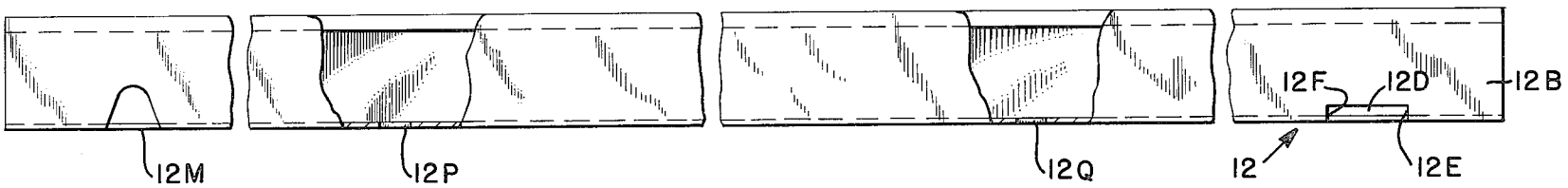

Various forms of the individual elements described so far are known in the art. However, several of those shown in FIGS. 1 and 2 are considered novel over the known prior art, as will appear from the further description of the structural and functional details of the various elements. More specifically, FIGS. 3 and 4 show the new blind head; FIGS. 5 to 7 show the novel structure of a cord lock mechanism 22; FIGS. 8 to 11 a novel structure of the cradle 38 and of the (tape) drum 28; FIGS. 12 to 18 of the novel tilter 30; FIGS. 19 and 20 of the end brackets 36; and FIGS. 21 to 28 of the bottom rail, cord and ladder cap, and end cap for the bottom rail.

The blind head shown in FIGS. 3 and 4 is a rolled sheet metal body having a bottom wall **12*a*, side walls 12*b* and 12*c*, with rolled flanges 12*g* and 12*h***, as well as various cut-outs and bores for the reception of other elements, which will be described further below.

The cord lock 22 illustrated in greater detail in FIGS. 5 to 7, comprises a sheet metal body with two parallel side walls **22*a* and 22*b*, a top wall composed of several portions, including a top wall portion 22*c* extending at right angles from the side wall 22*a*, a top wall portion 22*d* extending from side wall 22*b* at an angle that is somewhat larger than 90°, and a top wall portion 22*e* extending opposite top wall portion 22*d* over the space between side walls 22*a* and 22*b*. The upper end of top wall portion 22***d* ends in three fingerlike extensions, the two outer most of which, 22*f*, are essentially parallel to side wall 22*b* while the central finger 22*g* is bent somewhat downwardly. Side walls 22*a* and 22*b* are interconnected by an end wall 22*h*, which is provided with a bulge 22*i*. The entire cord lock body is made from one integral sheet of metal. Side wall 22*a* is somewhat longer than side wall 22*b*, using the top wall portion 22*c* as a reference plane. A pulley 22*j* extends between side walls 22*a* and 22*b* and is riveted thereto. Furthermore, a cam or knurled rivet 22*k* is movable within slots 22*m* inside wall 22*a* and 22*b* immediately adjacent to end wall 22*h*. The inside of this end wall 22*h* is provided with slight serrations or grooves 22*n*.

The bottom wall 12*a* of the venetian blind head 12 is provided with a cut-out 12*d* (FIGS. 3 and 4). The cord lock body 22, extends partially through this cut-out. More specifically, the lower portion of end wall 22*h* rests against edge 12*e* of the cut-out with bulge 22*i* preventing the cord lock body 12 from passing through the cut-out. Edge 22*p* of lock 22 rests against the opposite edge 12*f*. The opposite side wall 22*b* has a similar edge (not shown). Top wall 22*c* fits underneath a curved flange 12*g* of side wall 12*b* of the blind head, and similarly, the cord lock body 22 is held in place at flange 12*h* between the flanges 22*f* and 22*g*, as clearly shown in FIGS. 5 and 6. Because of the resiliency of the side walls and flanges of the head, the cord lock can easily be snapped into place and is positively held there.

When the blind is assembled, the strands 20*a*, 20*b* of lift cord 20 pass through cut-out 12*d* and from there between knurled rivet 22*k* and pulley 22*j*, over the top of pulley 22*j* and underneath top wall portion 22*e*. From there, one strand 20*a* passes through a bore 12*q* in the bottom wall 12*a* of the blind head and from there through slots 14*a* in slats 14, in well-known manner and bottom rail 18. The other strand 20*b* passes through a similar hole 12*p* further to the left in FIGS. 1 and 2, from there through slots 14*b* in slats and through the bottom rail 1. The connection of the lift cord strands 20*a* and 20*b* to the bottom rail 18 will be described later.

FIGS. 8 to 11 show details of the cradle 38 and drum 28. The cradle 38 is made of one integral piece of sheet metal. Cradle 38 has a substantially flat bottom wall 38*a* with three bores 38*b* which in assembled condition of the blind are aligned with bores 12*q* and 12*p*, and 12*i*, and 12*j*, respectively of blind head 12 (FIGS. 3 and 4). The cradle also has two upstanding opposite side walls 38*c* and 38*d*, each forming U-shaped bearing 38*e* for supporting the tile rod 26. Portions 38*f* and 38*g* of side walls 38*c* and 38*d* are bent backwardly to permit passage of the strands 20*a* and 20*b* of the lift cord along one side of the cradle (FIG. 2). The cradle is held in its proper position within the blind head 12, first by having edges 38*h* and 38*i* engage under flange portions 12*h* of the blind head, and second by having part of the material where the bores 38*b* are punched out of the bottom wall 38*a* form sleeves 38*j* (FIG. 8) which pass through the holes 12*q*, 12*i*, and 12*j*, 12*p* respectively in the bottom wall 12*a* of the blind head (FIG. 3). Finally, one or both fingers 38*m* and 38*n* are bent from the position shown in FIG. 9 into the plane of the end walls 38*c* and/or 38*d* respectively to engage the underside of the flange 12*g* on the opposite side of the blind head. Finally, at least one finger 38*p* is bent out of the position shown in FIG. 9 into the planes of the end walls 38*c* and/or 38*d*, respectively in order to prevent the tilt rod 26 from becomming lifted out of the cradle 38 when the same is in position in the blind head.

Figure 11:
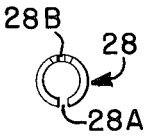
FIG. 11 is an end view of the drum of FIG. 10.
Figure 18:
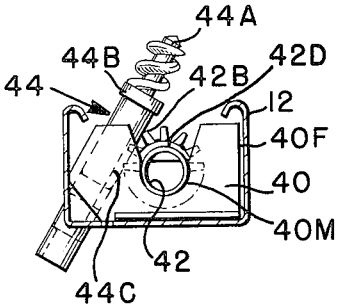

A drum 28 is journaled within each cradle 38. Drum 28 is made of a plastic material of sufficient strength and flexibility to perform its function, such as Nylon. The tape drum is essentially cylindrical with a slit 28*a* extending over its entire length in the bottom, as indicated in FIG. 11 to permit slipping the drum over tilt rod 26. The upper portion of the drum is provided with slots 28*b* extending only part way through from opposite ends and ending in circular holes 28*c* (only one being visible in FIG. 10). The upper end portions of the front and rear ladder sidepieces 16*a* and 16*b* are wound about the drum 28 and their ends are provided with barbs 16*d* and 16*e* respectively, where these ends are securely held to the drum.

Figure 12:
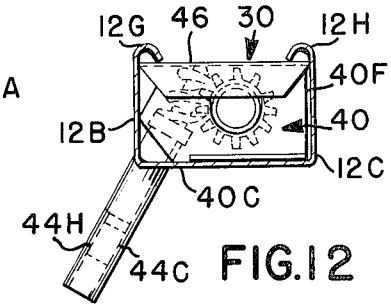
FIG. 12 is a section taken along the line 12—12 of FIG. 1 and shows the tilting mechanism of the venetian blind.

FIGS. 12 to 18 show the tilter for rotating the tilt rod 26. More specifically, FIG. 12 shows an end view of the assembled tilter 30, which includes a housing 40, a gear 42 journaled in housing 40, a worm shaft 44 likewise journaled in housing 40, and a cover 46.

The tilter housing 40 is made of plastic, for instance Nylon. It has a bottom wall 40*a* with a rectangular opening 40*b* and a depending edge 40*c*. It also had two parallel end walls 40*d* and 40*e*, and one essentially straight end wall 40*f*. The opposite end wall has two portions 40*g* and 40*i* arranged at an angle with respect to each other. Wall portion 40*i* is provided with a bore 40*j*. The end walls 40*d* and 40*e* are provided in the center thereof, with large cut-outs the lower portions 40*m* of which are slightly larger than a semi-circle to form U-shaped bearings for gear 42 while the flaring upper portions 40*n* permit insertion of the gear 42 into the bearing portion 40*m*, into which the gear snaps due to the resiliency of the material of housing 40.

Gear 42 (FIG. 13) made of metal comprises a sleeve 42*a* on the outer circumference of which teeth 42*b* are arranged which, however, occupy only a relatively small central portion of the length of the sleeve. On opposite sides sleeve 42*a* is provided with rims 42*d* (only one being visible in FIGS. 13, 17 and 18), with which the sleeve rests in bearing portions 40*m* of housing 40. Sleeve 42*a* is not entirely hollow, but is provided with a segment 42*c* by means of which the gear 42 can be positively located with respect to the tilt rod 26.

Figure 15:
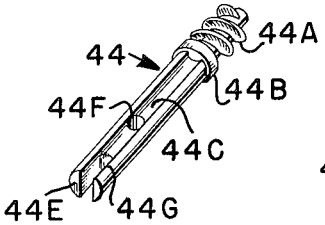

Gear 42 meshes with a worm 44*a* on a worm shaft 44 (FIG. 15). Worm shaft 44 is provided with an annular abutment 44*b* and with a groove 44*c* extending from abutment 44*b* to the end 44*e* of worm shaft 44. A bore 44*f* extends through the worm shaft and the lower end has a U-shaped passage 44*g*. The purpose for the provision of the passages 44*f* and 44*g* will be explained later on. There is also a groove 44*h* on the side opposite groove 44*c*. However, it extends only from the lower end 44*e* to bore 44*f* and not all the way up to abutment 44*b*. As will be evident from FIGS. 17 and 18, after gear 42 has been placed in bearing portions 40*m*, the worm shaft 44 can be inserted into housing 40 at an agle from the top, past two adjacent teeth 42*b* of gear 42, due to their resiliency, and if worm shaft 44 is rotated to the position in which the groove 44*c* faces the gear teeth 42*b*, and through bore 40*j*. In this way, the worm shaft can be pressed downwardly until the abutment 44*b* rests against the inside of wall 40*i* in housing 40.

Edge 40*c* of tilter housing 40 abuts against an edge 12*k* of head 12 while shaft 44 extends through opening 12*m* provided partly in bottom wall 12*a* and partly in side wall of head 12.

Finally, cover 46 which has a top wall 46*a* and side walls 46*b*, is placed over the assembly of housing gear 42 and worm shaft 44 and in turn is held in place by the flanges 12*g* and 12*h* of housing 12. Cover 46 prevents shaft 44 from being displaced out of the housing 40 upon rotation thereof by a wand 34 (FIG. 1). This wand 34 is connected to the worm shaft 44, in a well-known manner, as disclosed in U.S. Pat. No. 3,425,479 of Hans K. Lorentzen et al. More specifically, an S-shaped metal hook 35 extends into bore 44*f*, passage 44*g*, and is held in place by a sleeve 37.

The head channel 12 is provided at its ends with end braces 36, one of which is shown in FIGS. 19 and 20. Each end brace forms an integral sheet metal body and has an end wall 36*a* and side walls 36*b* and 36*c* connected to the end wall 36*a* and extending approximately at 90° angles with respect thereto. End wall 36*a* is provided with a bendable finger 36*d*. Part of the end wall and the finger are stiffened by a pressed-in rib 36*e*. Each side wall 36*b*, 36*c* is provided with two inwardly bent portions 36*f* and 36*g*. When the end brace is placed from the respective end into the blind head, side walls 36*b* and 36*c* respectively come to rest against the side walls 12*b* and 12*c* of head channel 12 while portions 36*f* engage under the flange portions 12*h* and 12*g* respectively of the head channel. Similarly, the bent portions 36*g* come to rest against the bottom wall 12*a* of the head channel. The end brace effectively closes the blind head, and the side walls 36*b* and 36*c* *I prevent the side walls 12g* and 12*h* from becoming compressed and from being bent out of shape. Also, the end brace helps in maintaining the cord lock and tilter in the head, and its end walls comfine the tilt rod within the head. Finally, the bendable finger 36*d* at end wall 36*a* may be bent out of the plane of the end wall, which makes it possible to adjust the position of the head relative to a bracket (not shown) mounting the blind head to a wall or the like.

Figure 24:
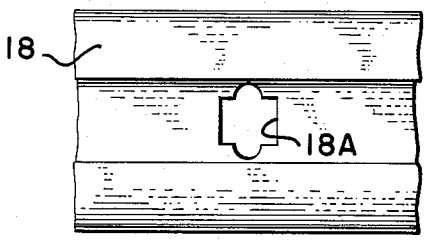
FIG. 24 is a top view of a portion of the bottom rail prior to the connection of the ladders to the bottom rail.
Figure 26:
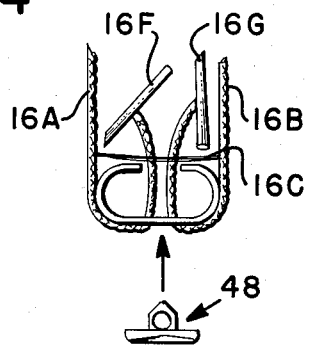
FIG. 26 is a section taken along the line 26—26 of FIG. 25 and shows a ladder and cord cap being inserted into the bottom rail from underneath.
Figure 25:
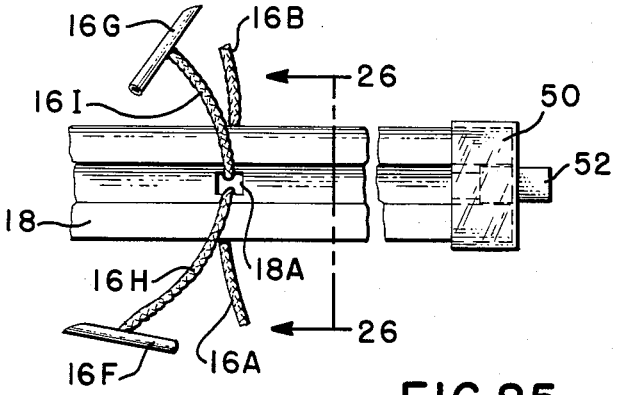
FIG. 25 is a top view of the bottom rail showing the manner of connecting the ends of the ladders thereto.
Figure 28:
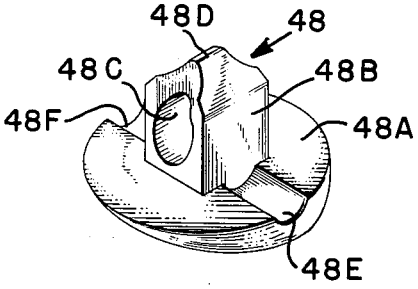
FIG. 28 is a perspective view of the ladder and cord cap of FIGS. 21 and 26.
Figure 27:
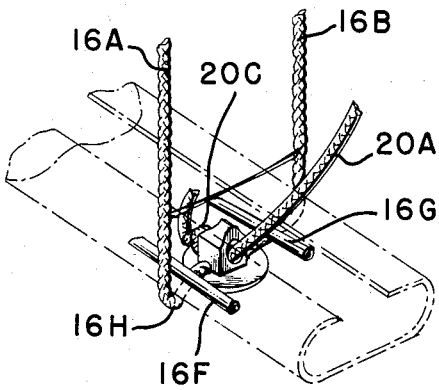
FIG. 27 is a perspective view of the bottom rail and ladder showing a later phase of the procedure for connecting the ladders to the bottom rail.

FIGS. 21 to 28 illustrate the bottom rail 18, cord and ladder cap 48, and end cap 50 for the bottom rail. More specifically, the lower ends of the front and rear side pieces 16*a* and 16*b* of the ladder are provided with barbs 16*f* and 16*g* respectively which are passed through a cut out 18*a* in the bottom rail 18, as shown in FIG. 24. Thereafter, cord and ladder cap 48 is passed through cut-out 18*a*, as indicated in FIG. 26. The structure of the ladder and cord cap is shown more clearly in the perspective view of FIG. 28. The cap is made, for instance, of Nylon and has a base 48*a*, an essentially cubic body 48*b* with a bore 48*c*, and a roof-like top 48*d*. The end of lift cord 20*a* (FIG. 27) is passed through bore 48*c* and the end is knotted at 20*c* in order to prevent escape of the end of lift cord 20*a* from cap 48. The lower end portions 16*h* and 16*i* of the front and rear side pieces 16*a* and 16*b* respectively, extend between troughs 48*e* and 48*f* in the cap 48, and bottom rail 18. Another cap is provided for lift cord 20*b*, and of course additional caps for any ladders that might be provided between lift cords 20*a* and 20*b*.

Each end of bottom rail 18 is closed by an end cap 50. The end cap is made of plastic material, such as Nylon. It is essentially an oval shell with a stud 52 extending therefrom and integral therewith by means of which the end cap once mounted to the bottom rail 18 can be held down by a bracket (not shown).

It is to be understood that the specification and drawing describe and show only one embodiment of the invention. Many modifications are possible within the scope of the appended claims. For instance, the materials stated are by way of example only and many others may be used, such as metal instead of Nylon for the tilter housing, tape drum and caps.

I claim:

1. A venetian blind having a head channel with side walls and flanges extending inwardly from said side walls, a plurality of slats, means provided in said head channel for suspending said slats from said head channel, means provided in said head channel for lifting and lowering said slats, and means associated with said head channel for tilting said slats from essentially horizontal positions to tilted positions and vice versa, said tilting means including: a housing placed in said head channel, said housing being a unitary molded piece of plastic open at the top and having a bottom wall, and a side wall having a portion inclined at an angle with respect to said bottom wall, a worm gear inserted into said housing from said top and rotatably supported in said housing, a tilt rod extending through said worm gear and rotatably mounted in said head channel and held in fixed rotational relationship thereto, and a worm shaft inserted into said housing from the top and supported by said side wall portion and having a worm in meshing engagement with said worm gear, said worm shaft being provided with a groove extending essentially longitudinally over the entire length thereof, said groove permitting said worm shaft to be inserted from the top of said housing by accommodating the teeth of said gear during insertion until the teeth of the worm mesh with the teeth of the worm gear, and a separate cover placed on said open top of said housing for holding said gear shaft in place when said housing is placed in said head and said cover is clamped between said top of said housing and said flanges.

2. The venetian blind according to claim 1, wherein said head channel is provided with an essentially rectangular opening, the bottom wall of said housing being provided with a lip resting against an edge defining said opening, and said worm shaft extending through said opening to the outside of said head channel.

* * * * *